US010879059B2

(12) United States Patent
Ferrari et al.

(10) Patent No.: US 10,879,059 B2
(45) Date of Patent: Dec. 29, 2020

(54) EXTENDED MICROWAVE POWERED LAMP

(71) Applicant: Consiglio Nazionale delle Ricerche, Rome (IT)

(72) Inventors: Carlo Ferrari, Rome (IT); Iginio Longo, Rome (IT)

(73) Assignee: CONSIGLIO NAZIONALE DELLE RICERCHE, Rome (IT)

( * ) Notice: Subject to any disclaimer, the term of this patent is extended or adjusted under 35 U.S.C. 154(b) by 0 days.

(21) Appl. No.: 14/776,121

(22) PCT Filed: Mar. 14, 2014

(86) PCT No.: PCT/IB2014/059816

§ 371 (c)(1),
(2) Date: Sep. 14, 2015

(87) PCT Pub. No.: WO2014/141186

PCT Pub. Date: Sep. 18, 2014

(65) Prior Publication Data

US 2016/0005589 A1 Jan. 7, 2016

(30) Foreign Application Priority Data

Mar. 15, 2013 (IT) ..... RM2013A0162

(51) Int. Cl.
*H01J 65/04* (2006.01)
*H01J 61/94* (2006.01)

(52) U.S. Cl.
CPC ..... *H01J 65/044* (2013.01); *H01J 61/94* (2013.01)

(58) Field of Classification Search
CPC ..... H01J 61/94; H01J 65/044
See application file for complete search history.

(56) References Cited

U.S. PATENT DOCUMENTS 2,488,169 A * 11/1949 Browner ..... G09F 13/26 315/250
4,178,534 A * 12/1979 McNeill ..... H01J 65/048 313/640

(Continued)

OTHER PUBLICATIONS

Ferrari, et al.: "A Novel Microwave Photochemical Reactor for the Oxidative Decomposition of Acid Orange 7 Azo Dye by MW/UV/H2O2 Process"; Journal of Photochemistry and Photobiology, A: Chemistry, vol. 204, No. 2-3, May 20, 2009, pp. 115-121, Abtract only.

*Primary Examiner* — Kurtis R Bahr
(74) *Attorney, Agent, or Firm* — Volpe Koenig

(57) ABSTRACT

An elongated microwave powered lamp (1) having one or more bulbs with any length or shape or disposition according to a linear series, straight or curved, includes: at least one transparent elongated bulb (2) containing, in an inner space thereof, a material apt to be excited by microwave irradiation thereby emitting an electromagnetic radiation; a coaxial microwave antenna placed outside the bulb (2) and respectively connected to a microwave source (81) via corresponding antenna lead (91), said bulb (2) and said at least one microwave coaxial antenna being displaced in a close relationship to each other to allow the microwave excitation of said material, wherein the outer tubular conductor of the coaxial antenna (5) has spaced holes (6) formed therethrough and facing the bulb (2), at which microwaves are released toward the bulb.

12 Claims, 3 Drawing Sheets

(56) References Cited

U.S. PATENT DOCUMENTS

| | | | | |
|---|---|---|---|---|
| 4,189,661 | A | 2/1980 | Haugsjaa et al. | |
| 4,266,167 | A | 5/1981 | Proud et al. | |
| 4,586,115 | A * | 4/1986 | Zimmerman | F21V 23/00 315/248 |
| 4,643,186 | A * | 2/1987 | Rosen | A61B 17/22 606/159 |
| 5,013,976 | A | 5/1991 | Butler | |
| 5,114,372 | A | 5/1992 | Fuchs | |
| 5,216,322 | A * | 6/1993 | Fuchs | C02F 1/325 313/484 |
| 6,731,074 | B2 | 5/2004 | Suzuki | |
| 6,863,773 | B1 * | 3/2005 | Emmerich | H01J 37/3222 118/723 MW |
| 7,095,163 | B2 * | 8/2006 | Longo | H01J 65/044 313/17 |
| 8,328,799 | B2 * | 12/2012 | Brannan | A61B 18/1815 606/41 |
| 2008/0245976 | A1 * | 10/2008 | Eastlund | G03B 21/2006 250/494.1 |
| 2014/0038431 | A1 * | 2/2014 | Stowell | H05B 6/702 438/795 |

* cited by examiner

EXTENDED MICROWAVE POWERED LAMP

BACKGROUND OF THE INVENTION

1. Field of the Invention

The present invention is related to a elongated microwave powered lamp, generally described as an electrodeless lamp wherein a plasma material is excited by radio frequencies, namely in the microwave frequency range, to emit light.

2. Description of the Prior Art

This kind of electrodeless lamp is generally known from U.S. Pat. No. 5,013,976 A, U.S. Pat. No. 4,189,661 A and U.S. Pat. No. 4,266,167 A.

A lamp of this kind was described in U.S. Pat. No. 4,586,115 A (Zimmerman et al.), wherein a lighting system includes tubular transparent enclosures filled with a radiation responsive fluorescent material on its interior wall surface, and containing a gas responsive to radio frequency electromagnetic radiation to activate said fluorescent material. Generating means for generating radio frequency electromagnetic energy were provided, transmitting said radio frequency electromagnetic energy through coaxial cables connected to a single coaxial antenna of said generating means for each of said enclosures.

U.S. Pat. No. 7,095,163 B2 (Longo) is referred to a lamp without electrodes comprising one bulb having inside a material capable of being excited by means of microwaves irradiation, a recess formed in walls of the bulbs, accessible from the outside and a source of microwaves radiation inserted into said recess, namely one or two antennas energized by an antenna lead connected to means for exciting the microwave source.

U.S. Pat. No. 6,731,074 B2 (Suzuki) discloses an electrodeless lamp equipment comprising a microwave-generating source and a microwave chamber receiving the microwaves from antennas energized through appropriate and respective waveguides connecting the generating source and an antenna end. Said antennas are located at the ends of an elongated bulb to better extend the lighting power along the whole bulb.

It should be noted that, in the last examples of prior art, the multiple antennas do not cooperate to with each other along the whole length of an elongated bulb, to obtain the best possible interaction between antennas and the plasma material inside the bulb, whereas the use of a single antenna for an elongated lamp would be simpler.

U.S. Pat. No. 5,216,322 A and U.S. Pat. No. 5,114,372 A disclose a method for producing a gas discharge light source for emitting an electromagnetic radiation using includes a gas discharge tube filled with at least one discharge gas material and having a device for generating a gas discharge.

The latter device (FIG. 4 of both documents) includes a tubular metallic waveguide having a predetermined diameter D and therefore apt to transport microwaves having wavelength smaller than 1.706 D. Slits are formed along the metallic tube for allowing microwaves to leak toward a discharge tube; again there must be a narrow relationship between the shape of the slits and the microwave wavelength for allowing the radiation to leak outside the waveguide.

It is apparent that such an arrangement can hardly be used as a lamp, wherein different bulbs and different microwave wavelengths may be used with the same source and the same microwave tubular waveguide. Also, it cannot implement bulbs with variable curvature, without breaking the bulb during the insertion of the rigid tube.

SUMMARY OF THE INVENTION

The technical problems underlying the present invention is to provide a microwave energized lamp allowing to obviate to the drawbacks mentioned with reference to the prior art.

Such problem is solved by a elongated microwave powered lamp including:

- at least one transparent elongated bulb containing, in an inner space thereof, a material apt to be excited by microwave irradiation thereby emitting an electromagnetic radiation;
- a coaxial microwave antenna, placed outside the bulb, respectively connected to a microwave source via corresponding antenna lead, the coaxial antenna having an inner wire conductor and a coaxial cable outer conductor separated by a dielectric material, said bulb and said at least one microwave antenna being displaced in a close relationship to each other to allow the microwave excitation of said material, wherein said coaxial cable outer conductor has spaced holes facing the bulb, at which microwaves are released toward the bulb.

According to the invention, the microwaves from a single antenna leak outside the outer conductor through said spaced holes, allowing to distribute the microwave power along a bulb with a greater length, or along a series of bulbs forming a continuous bulb profile.

This kind of lamp may be arranged for the production of a visible, UV, or IR, pulsed or continuous radiation, within either a spectral or wide band wavelength range, especially with high lighting or heating powers in a safe and reliable way, without losing the compactness and the efficiency of the microwaves lamps directly excited by a microwave antenna, just varying power and wavelength of the generated microwaves then transmitted through said coaxial antenna.

DESCRIPTION OF THE PREFERRED EMBODIMENTS

Figure 1:
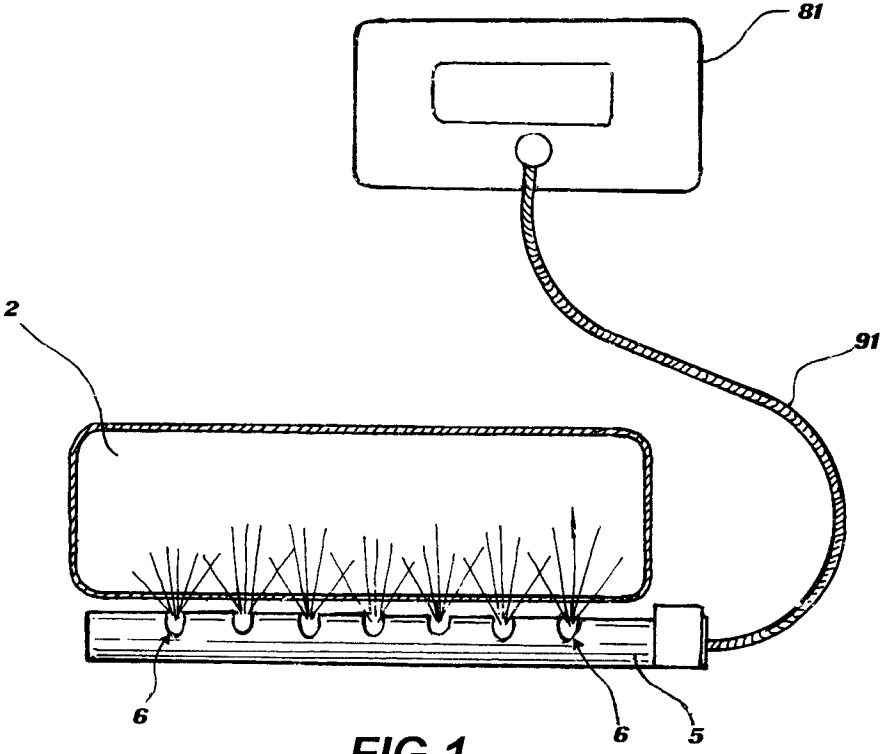
FIG. 1 shows a schematic sectional view of a first embodiment of a lamp according to the present invention.

In the drawings and for all the embodiments herein described, a microwave energized lamp is generally indicated as 1. It comprises at least an elongated bulb 2 defined by a continuous external thick wall, of a material substantially transparent to the visible, UV, IR radiation, and to the MW radiation as well, e.g. glass, possibly a heat resistant glass suitable for lamp bulbs.

The elongated bulb 2 defines a closed chamber containing a microwaves irradiation excitable material, which may be a gas, a vapour, a dust, or a liquid, capable of emitting radiation by activation with other electromagnetic radiation and/or owing to hits between neutral or ionized particles (plasma atoms or molecules). The material can be put in with either a certain rate of vacuum or at a pressure higher than the atmospheric. A mixture of gases or vapors, or only a single atomic or molecular species can be used.

In general terms, the bulb 2 may have any shape, e.g. a tubular shape comprising two opposite bulb ends 21, 22. In the embodiment of FIG. 1, the lamp 1 then comprises one microwave coaxial antenna, which is connected to a microwave source 81 via a respective antenna lead 91.

This kind of coaxial antenna is substantially obtained from a coaxial cable having an inner wire conductor forming the core of the cable, an outer tubular conductor surrounding the inner wire conductor, a tubular insulator layer made of a dielectric material placed between the inner wire conductor and the outer tubular conductor to electrically separate them. Conventionally, this kind of antenna is flexible and it can be bent or curved.

The antenna lead 91 is instead embodied by a section of coaxial cable connected to said microwave source, comprising both the inner and the outer conductors.

The coaxial antenna, could have in principle any length to cope with different shapes and lengths of the bulb 2. It is noted that, in all the embodiments of the invention, the coaxial antenna is placed outside the bulb 2, i.e. in an outer space with respect to the bulb 2.

It should be noted that the coaxial antenna 5 may have any length and any kind of linear shape. For the sake of clarity, the coaxial antenna 5 of FIG. 1 is straight.

Further, the coaxial antenna 5 has a length and a shape to be placed in a close relationship with said bulb 2, but being placed in any case outside the bulb itself, to allow the microwave excitation of the plasma material.

According to the invention, the coaxial antenna 5 is provided with spaced holes 6 formed through its outer tubular conductor along the length thereof, from which the microwaves are generated. In this connection, said holes 6 are faced to the bulb 2.

The holes 6 can be arranged in any shape and/or disposition. In particular, the holes 6 may be circular ports or annular apertures, to radially irradiate microwaves from the coaxial antenna.

With reference to FIG. 1, the holes are spaced with predetermined and suitable intervals along the bulb length, to irradiate the whole bulb in a uniform manner.

In particular, a regular distribution may serve to uniformly distribute a microwave power alon a long distance coaxial antenna. Otherwise, the holes may be spaced and possibly concentrated to reach the best irradiation efficiency for the bulb or bulbs.

It is apparent that this kind of arrangement allows lengthening the bulb, so as to obtain a very elongated lamp 1.

Figure 2:
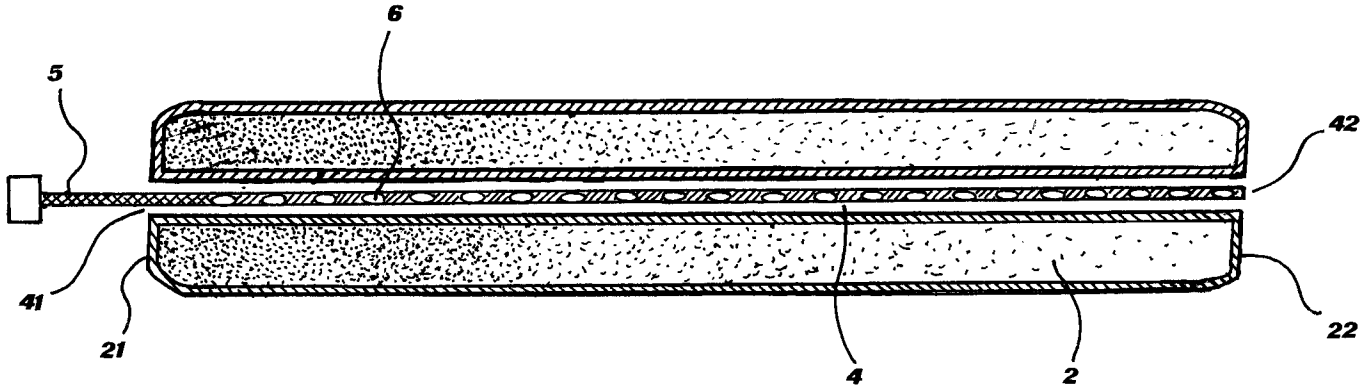
FIG. 2 shows a schematic sectional view of a second embodiment of a lamp according to the present invention.

With reference to FIG. 2, the bulb 2 has a tubular and symmetrical shape. Further, the bulb 2 is shaped so as to form a coaxial open channel 4 that, in the present embodiment, is a passing through hole extending end-to-end inside the bulb 2 from one bulb end 21 to the other 22. The open channel 4 has a straight and tubular shape too, with two opposite channel end apertures 41, 42 at said opposite respective ends 21, 22 of the bulb 2.

In this embodiment, the coaxial antenna 5 is inserted inside the open channel 4, possibly with spacers (not shown) arranged so as to leave a toroidal channel between the bulb walls and the coaxial antenna 5. In particular, the coaxial antenna 5 is inserted through one of the open channel end apertures 41. In this preferred embodiment, the open channel 4 is coaxial to the elongated tubular bulb 2, achieving with the coaxial antenna 5 a symmetrical arrangement around the longitudinal axis.

The coaxial antenna 5 of the present embodiment has annular holes 6, spaced at regular intervals along the open channel 4, so as to irradiate the bulb 2 from the inner core thereof in a uniform manner. It is intended that the distribution of the holes may not be uniform for special purposes.

Figure 3:
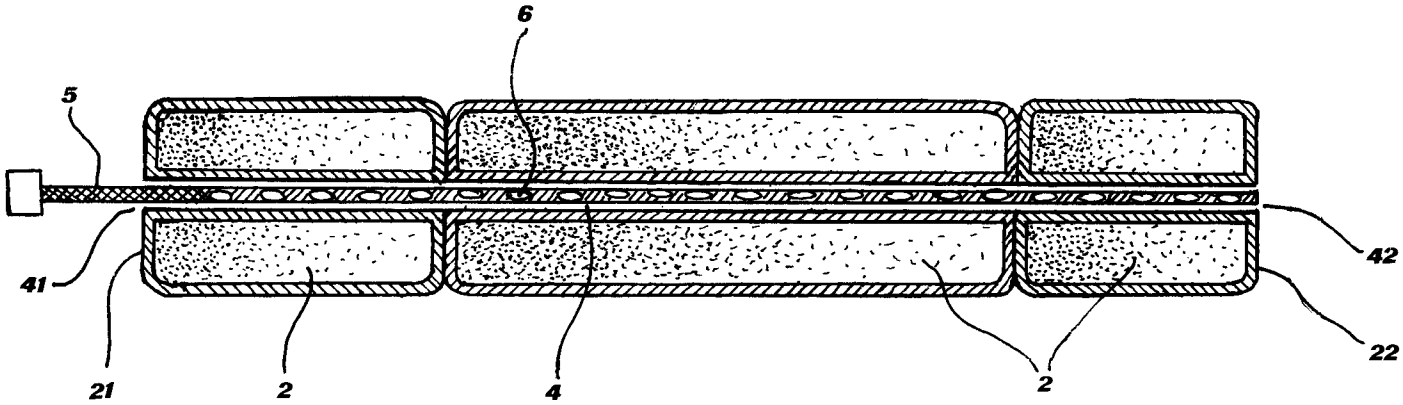
FIG. 3 shows a schematic sectional view of a third embodiment of a lamp according to the present invention.

According to the embodiment of FIG. 3, the lamp 1 comprises several elongated and tubular bulbs substantially consistent with the bulb described with reference to the second embodiment. However, in this third embodiment, the bulbs 2 are put in series, so as to form a common open channel 4 along the bulb series.

Again, the coaxial antenna 5 is inserted inside the open channel 4, possibly with spacers (not shown) arranged so as to leave a toroidal channel between the bulb walls and the coaxial antenna 5. In particular, the antenna 5 is inserted through one of the open channel end apertures 41 at a side bulb 2. In this preferred embodiment, the open channel 4 is coaxial to the elongated tubular bulb 2, achieving with the the coaxial antenna 5 a symmetrical arrangement around the longitudinal axis.

The coaxial antenna 5 of the present embodiment has annular holes 6 through the outer tubular conductor thereof, spaced at predetermined intervals along the open channel 4, so as to irradiate the bulb 2 from the inner core thereof in a uniform manner. It is intended that the distribution of the holes may not be uniform for special purposes.

It is also intended that the bulbs 2 may have different lighting characteristics, e.g. different colours, shapes, lengths.

Figure 4:
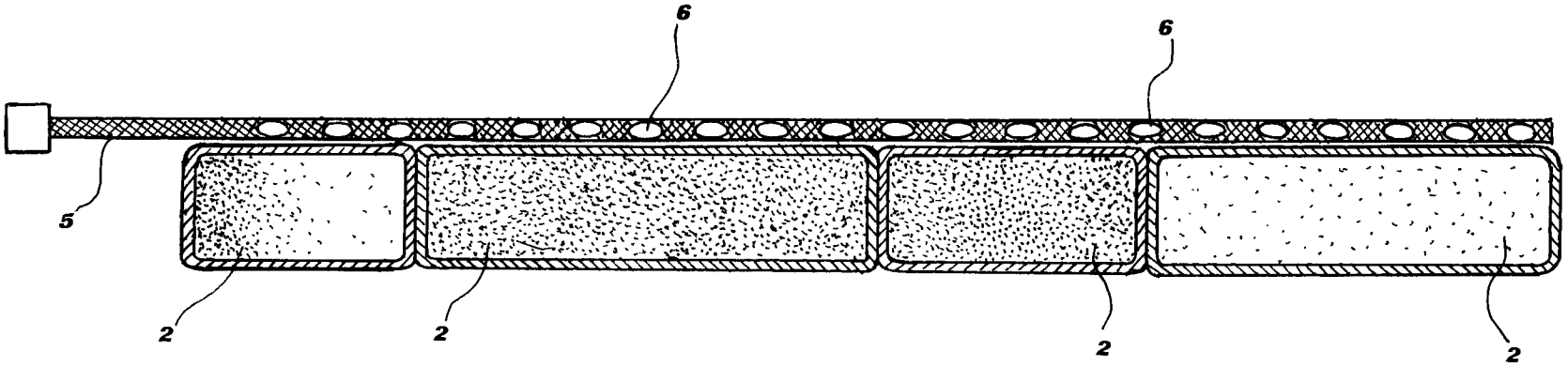
FIG. 4 shows a schematic sectional view of a fourth embodiment of a lamp according to the present invention.

With reference of FIG. 4, simple tubular bulbs 2 are put in a linear series to form a straight succession of bulbs, and the antenna 5 is put adjacent to this succession, to follow the bulb profile. It is intended that the bulbs 2 may have different lighting characteristics, e.g. different colours, shapes, lengths.

In this embodiment, the coaxial antenna 5 has circular holes at the same side of the antenna 5 facing the bulbs 2. The holes 6 can be either spaced with regular intervals to uniformly irradiate the bulbs along the succession, or distributed according to special patterns, adapted to the bulb features.

Figure 5:
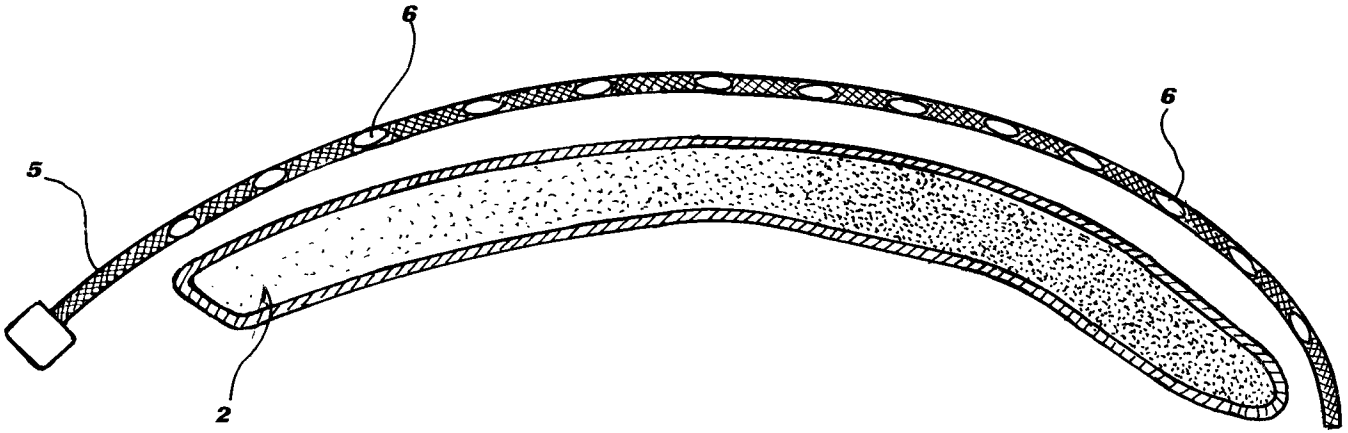
FIG. 5 shows a schematic sectional view of a fifth embodiment of a lamp according to the present invention.

With reference of FIG. 5, a bent or curved elongated bulb 2 is shown, with a shape adapted to any kind of special circumstances. The coaxial antenna 5, behaving like a flexible cable, is formed and shaped so as to follow the bulb profile, keeping the holes 6 adjacent to the bulb 2 and facing thereto. Again, the bulb may have any length or shape, and the coaxial antenna 5 may have predetermined hole distribution along the length thereof, possibly a regular distribution or a non uniform one. It is apparent that such an arrangement can be allowed only by using a coaxial cable as microwave antenna.

The lamp is capable of emitting radiation with a line spectrum, a band spectrum or mixed spectrum, in a wide range of wavelengths. It works without any electrodes in contact with the particles that emit the radiation, in a continuous or pulsed way. The spectral composition of the radiation as emitted depends from the substances used for filling the bulb, their quantity ratio, as well as the power and the frequency of the microwaves used for excitation.

To the above described microwave powered lamps a man skilled in the art, in order to meet specific requirements and contingencies, may bring further modifications, all falling within the scope of protection of the present invention, as defined by the annexed claims.

The invention claimed is:

1. An elongated microwave powered lamp (1) comprising:

at least one transparent elongated bulb (2) containing, in an inner space thereof, a material apt to be excited excitable by microwave irradiation to generate a plasma, thereby emitting an electromagnetic radiation;

a coaxial microwave antenna (5), placed in an outer space with respect to the bulb (2), respectively connected to a microwave source (81) via corresponding antenna lead (91), the coaxial antenna being a flexible coaxial cable that is bendable or able to be curved, to conform to an outer profile of the bulb (2) having an inner wire conductor and a tubular outer conductor separated by a dielectric material, said bulb (2) and said at least one microwave coaxial antenna (5) being displaced in a dose relationship to each other to allow the microwave excitation of said material, wherein said tubular outer conductor has spaced holes (6) facing the bulb (2) formed in said coaxial cable outer conductor, at which microwaves are released toward the bulb, wherein the holes (6) are annular ports evenly distributed along the length of the bulb, the annular ports configured to evenly distribute microwave irradiation to irradiate the entire bulb (2) in a uniform manner, regardless of the length or shape of the bulb (2).

2. The elongated microwave powered lamp (1) according to claim 1, wherein said at least one bulb (2) has a tubular and symmetrical shape along the longitudinal axis thereof.

3. The elongated microwave powered lamp (1) according to claim 2, wherein said at least one bulb (2) is shaped so as to form a coaxial passing through open channel (4) extending end-to-end inside the bulb (2) from one bulb end (21) to the other (22), the open channel (4) having two opposite channel end apertures (41, 42) at said opposite respective ends (21, 22) of the bulb (2), said antenna being inserted inside the open channel (4).

4. The elongated microwave powered lamp (1) according to claim 1, wherein said at least one bulb (2) is shaped so as to form a coaxial passing through open channel (4) extending end-to-end inside the bulb (2) from one bulb end (21) to the other (22), the open channel (4) having two opposite channel end apertures (41, 42) at said opposite respective ends (21, 22) of the bulb (2), said antenna being inserted inside the open channel (4).

5. The elongated microwave powered lamp (1) according to claim 1, comprising more than one bulb (2) put in series to form a linear succession of bulbs (2) irradiated by said antenna (5).

6. The elongated microwave powered lamp (1) according to claim 5, wherein the bulbs (2) have different lighting characteristics, selected from the group consisting of: colors, shapes, and lengths.

7. The elongated microwave powered lamp (1) according to claim 1, wherein said at least one bulb (2) is bent or curved, the coaxial antenna (5) being formed and shaped so as to follow the bulb profile, keeping the holes 6 adjacent to the bulb (2) and facing thereto.

8. The elongated microwave powered lamp of claim 1, wherein the lamp produces at least one of a: visible, UV, or IR radiation that is either pulsed or continuous.

9. The elongated microwave powered lamp of claim 8, wherein the radiation is within either a spectral or wide band wavelength range, having uniform high lighting or heating powers.

10. The elongated microwave powered lamp of claim 8, wherein the type of radiation produced by varying power and wavelength of the generated microwaves, which are then transmitted through said coaxial antenna.

11. The elongated microwave powered lamp of claim 8, wherein the type of radiation produced is a line spectrum, a band spectrum or mixed spectrum, in a varying range of wavelengths.

12. The elongated microwave powered lamp of claim 11, wherein a spectral composition of the radiation emitted is variable based on the type of substances used for filling the bulb, a quantity ratio thereof, and is also dependent on a power and a frequency of the microwaves used for excitation.

* * * * *